United States Patent [19]

Wolfe et al.

[11] 3,969,696

[45] July 13, 1976

[54] REFRACTORY RESISTOR WITH SUPPORTING TERMINAL

[76] Inventors: Denis G. Wolfe, Santa Ana; Richard K. Mitts, Fullerton, both of Calif.; Wilbur F. Jackson, deceased, late of Rolling Hills, Calif.; by Linda A. Benton, trust administrator, Long Beach, Calif.

[73] Assignee: Robertshaw Controls Company, Richmond, Va.

[22] Filed: Sept. 19, 1973

[21] Appl. No.: 398,889

[52] U.S. Cl. ..... 338/315; 219/541; 338/329; 338/332

[51] Int. Cl. ..... H01c 1/14

[58] Field of Search ..... 338/322, 315, 329, 330, 338/332, 334; 317/98; 219/541

[56] References Cited

UNITED STATES PATENTS

| | | | |
|---|---|---|---|
| 895,857 | 8/1908 | Hayden | 338/329 |
| 3,307,136 | 2/1967 | Fitzer | 338/330 |

*Primary Examiner*—E. A. Goldberg
*Attorney, Agent, or Firm*—Anthony A. O'Brien

[57] ABSTRACT

The end of an elongated resistance element, such as a molybdenum disilicide rod, is joined to a metal member which provides both electrical connection and mechanical support.

21 Claims, 5 Drawing Figures

REFRACTORY RESISTOR WITH SUPPORTING TERMINAL

BACKGROUND OF THE INVENTION

1. Field of the Invention:

The invention relates to electrical terminals for elongated elements, and in particular, to an electrical supporting terminal for a high temperature element, such as a molybdenum disilicide resistance element used as an igniter or sensor for a flame.

2. Description of the Prior Art:

Prior art terminals for igniter elements including molybdenum disilicide elements, as exemplified in U.S. Pat. Nos. 1,496,596, 2,384,797, 3,522,574, 3,562,590, 3,569,787 and 3,662,222 have been made by crimping, brazing, soldering, welding, bonding or otherwise joining metal terminal members or sleeves to the elements. Generally, the prior art terminals for molybdenum disilicide elements have been of limited suitability due to failure at or near the junction between the element and the terminal members during the joining process, handling shocks or repeated use; some of the failures result from rapid deteriation in strength and conductivity of materials used in making the terminals or junctions. Welding the elements to heat-resistant metal terminals avoids failures due to rapid deteriation in strength and conductivity of the terminals; however, welding of molybdenum disilicide elements to commonly used heat-resistant metals has previously not been entirely satisfactory because the elements tend to break at or near the welded junction during or after the welding process. Provision of separate mechanical support for molybdenum disilicide elements eliminates some of the failures during subsequent handling; however, such provision has not been completely successful, and also failures still occur prior to providing the mechanical support.

Additionally, a number of techniques have been developed in the prior art to connect dissimilar metal members, such as conductors, tubes, etc. used in relatively low temperature applications, as exemplified by U.S. Pat. Nos. 3,656,092, 3,244,798 and 2,914,641. Generally, such techniques are inapplicable or unsuitable for high temperature electrical resistance elements, such as molybdenum disilicide elements, in that the materials employed are substantially deteriorated in strength or conductivity by high temperatures, air and fuel.

SUMMARY OF THE INVENTION

The invention may be summarized in that a resistance and terminal includes an elongated electrical resistance element made from a conductive refractory material which is weakened where subjected to a substantial temperature gradient, a metal supporting member extending along a segment of the element from one end of the element and at least partially surrounding the segment of the element, a fused portion having constituents of the supporting member metal and the refractory material joining the one end of the resistance element to the supporting member, and the supporting member having an unfused portion along a substantial portion of the segment providing mechanical support for the element where subject to weakening.

An object of the invention is to provide an elongated resistance element with a terminal which electrically connects and mechanically supports the element.

Another object is to eliminate breakage or failure at or near the junction of a refractory resistance element and a terminal.

It is also an object of the invention to mechanically support a refractory resistance element where it is subject to weakening due to a temperature gradient near a terminal.

A further object of the invention is to provide a terminal made from materials capable of withstanding high temperatures associated with a refractory resistance element.

A still further object is to accommodate for a difference in expansion coefficients between a resistance element and a support.

One advantage of the invention is that it makes possible the manufacture and employment of a more practical electrical igniter for fluid fuel burners.

Additional features of the invention include the provision of a resistance element of molybdenum disilicide, the provision of a support of high temperature metal for electrically connecting and mechanically supporting a resistance element, the provision of a solidified-from-melt-portion for mechanically supporting an element where it is subject to stress, the provision of an interposed malleable layer for preventing failure of a juncture to a resistance element, and the provision of an outer sleeve with a reduced opening beyond an inner sleeve to provide beam support for a resistance element.

Other objects, advantages and features of the present invention will become apparent from the following description of the preferred embodiments taken in conjunction with the accompanying drawings.

DESCRIPTION OF THE PREFERRED EMBODIMENT

The term "metal" as used herein includes all elements, compounds and mixtures or alloys thereof which may be fused and used as conductors of electricity and heat.

Figure 1:
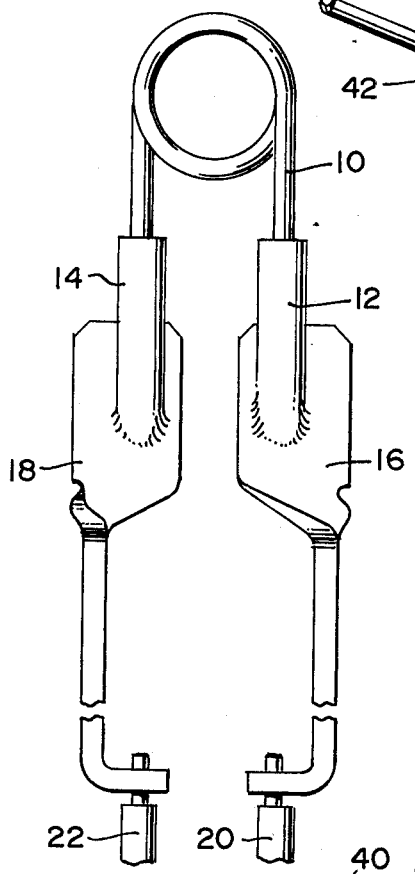
FIG. 1 is a plan view showing an electrical resistance device which includes a resistance element and terminals on the ends thereof in accordance with the invention.

As illustrated in FIG. 1, the present invention is embodied in an electrical resistance device which has an elongated electrical resistance element 10 with substantially identical supporting terminals 12 and 14 joined to similar metal terminal strips 16 and 18 which are connected to electrical wires 20 and 22.

The electrical resistance element 10 is made from an electrical resistance refractory material such as silicon carbide or molybdenum disilicide mixed with minor portions of ceramics and/or other materials; such molybdenum disilicide elements being commercially available. Molybdenum disilicide elements, while initially having substantial strength and ability to withstand shock, have been subject to subsequently becoming weakened and embrittled. It is discovered that weakening and embrittlement of molybdenum disilicide elements is caused by relatively large temperature gradients; such temperature gradient weaknesses being curable by an annealing process of heating and slowly cooling. Also it is discovered that some failures of molybdenum disilicide elements and welded junctions to heat-resistant metal terminals are the result of dissimilar temperature-expansion coefficients and other incompatible material properties. The combined or individual effects of temperature gradient weakening and stress from dissimilar temperature expansion coefficients are believed to be substantial causes of past failures of refractory resistance elements and terminals joined by processes involving heat, such as welding, brazing, soldering, etc.

Figure 3:
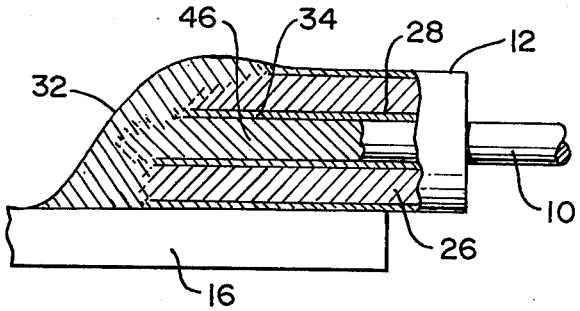
FIG. 3 is a detailed side view partially in cross section illustrating a completed terminal on the resistance element of FIG. 1.

As shown in FIG. 3 the terminal 12 has a sleeve 26 of high temperature or resistant metal over a segment at one end of the element 10 with a layer 28 of malleable metal interposed between the sleeve 26 and the element 10. A fused portion 32 joins one end of the sleeve 26, the interposed layer 28 and the element 10. The fused portion 32 has constituents of the heat resistant metal, the malleable metal and the element 10.

The sleeve 26, as illustrated, has a tubular configuration surrounding the outside surface of the element 10 near its end; however, the term "sleeve" includes support members or sleeves having a longitudinally slit wall or only partially surrounding the element 10 which can be employed with equal success. Sleeves circumscribing more than 180° of the cross sectional circumferences of the element 10 provide maximum support against lateral stress.

The heat resistant metal of the sleeve 26 is selected for its strength and its ability to withstand high temperatures generally up to 260°C (500°F) and preferrably up to or greater than 843°C (1,550°F) in air without any substantial deterioration of its stregnth or conductive properties. Generally, suitable heat resistant metals can be selected from the chromium steel alloys commonly referred to as stainless steels, such as stainless steel type 446 containing from about 23 percent to 30 percent chromium and about 0.35 percent carbon with the rest iron and other minor constituents, or type 18SR stainless steel from Armco Steel Corporation.

The malleable metal of the interposed layer 28 is selected to form a malleable interface in the fused portion 32 which has a composition gradient that smoothly changes across the interface. Additionally, the malleable metal has a melting point which is substantially less than the melting points of either the metal of the sleeve 26 or the element 10 to form at least a portion 34 of the interposed layer 28 which is unfused but solidified from a let to surround and engage a portion 46 of the element 10 contiguous and adjacent to the fused portion 32 to provide support for the element 10. The malleable metal has a hardness less than 200 Knoop, as measured using Knoop standard hardness testing techniques, and is capable of withstanding temperatures generally up to 260°C and preferrably up to or greater than 843°C without any substantial deterioration of its conductive properties and without melting. Silver has been found to be a suitable metal for the interposed layer 28. The solidified-from-melt portion 34 has substantially less conductivity, both electrical and thermal, per unit area of contact with the element 10 than the conductivity per unit area of the fused portion 32 with the element 10 due to the nature of the engagement between the solidified-from-melt portion 34 and the element 10, the silicon dioxide coating which is formed on exposed surfaces of molybdenum disilicide, and/or other factors.

The terminal 12 is illustrated as including a separate sleeve 26 with a separate malleable layer 28. Alternately, a sleeve without a separate malleable layer 28 can be employed providing the sleeve is made from a compatible heat resistant metal which has a suitable temperature coefficient, a suitable malleability and a suitable melting point to form the fused portion 32 and the unfused supporting portion with a solidified-from-melt portion.

The terminal strip 16 is made from a heat resistant metal which can be the same metal as the sleeve 26. As shown in FIG. 1, the strip 16 has a length extending from the terminal 12 which is designed to dissipate the heat from the terminal 12 to prevent excessively heating the junction of the wire 20 and the strip 16. The strip 16 is attached to the wire 20 by a conventional crimping or bonding operation. The wire 20 is typically a high temperature insulated multistrand copper conductor.

Figure 2:
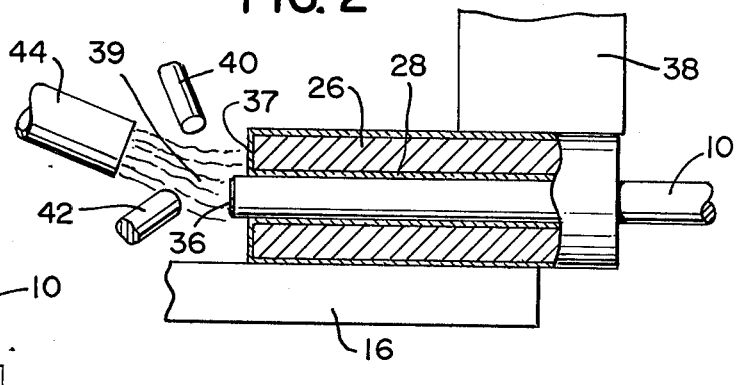
FIG. 2 is a detailed side view partially in cross section illustrating the manufacture of one of the terminals on the resistance element in FIG. 1.

FIG. 2 illustrates the manufacture of the terminal 12 on the element 10. The sleeve 26 is first formed in any conventional manner, such as cutting from tubular stock, rolling from a flat stock, or the like, and is then coated with a layer of malleable metal to form the interposed layer 28, by a conventional coating process, such as electroplating, dipping, vacuum evaporation, sputtering, etc. The optimum range of thicknesses for the layer 28 depends upon the diameter of the element 10, the wall thickness of the sleeve 26 and the specific metals employed. For elements of molybdenum disilicide of about 0.762 millimeters (0.030 inches) in diameter and sleeves of stainless steel type 446 of about 0.762 millimeters (0.030 inches) in wall thickness, a layer 28 of silver of from 0.0127 to 0.0508 millimeters (0.0005 to 0.002 inches) produces acceptable results. The inside diameter of the sleeve 26 is selected so that when coated it will be only slightly larger than the element 10, for example about 0.0381 millimeters (0.0015 inches) larger. It is not necessary that the malleable metal be coated on the exterior surfaces of the sleeve 26, it is sufficient if coated only on the interior surface of the sleeve. Alternately, the interposed layer 28 may be formed by coating the ends of the element 10 or using a thin sleeve of the malleable metal interposed between the sleeve 26 and element 10.

The end 36 of the element 10 and the end 37 of the sleeve 26 are aligned to be about flush or adjacent and positioned on the metal strip 16 with a heat sink 38 engaging a forward portion of the sleeve 26. Intense heat, such as a plasma arc 39 generated by pilot electrodes 40 and 42 and gas and electric current from a tubular electrode 44, is applied to the strip 16 to preheat the strip 16, and then is applied to the sleeve 26 and element 10 at the ends 36 and 37 to form the fused portion 32 from the sleeve 23, the interposed layer 28 and the element 10 as shown in FIG. 3. Also the heat welds the fused portion 32 to the metal strip 16 and melts the portion 34 of the interposed layer 28 which flows around the element filling the space between the sleeve and the element. After fusing, the electrodes 38, 40 and 42 are immediately withdrawn to allow the terminal 12 to cool in room atmosphere to prevent any large temperature gradient in the element 10 beyond a portion 46 supported by the solidified-from-melt portion 34. During the cooling, the malleable nature of the alloyed fused portion 32 and the malleable nature of the layer 28 accommodates for any differences in the expansion coefficients of the sleeve 26 and element 10 to prevent breakage.

In employing the resistance device shown in FIG. 1 as an igniter or sensor for a flame, the device is suitably installed and current is applied from a source (not shown) through the wires 20 and 22, metal strips 16 and 18, terminals 12 and 14 and the element 10. Generally elements, such as molybdenum disilicide elements, have resistance characteristics which increase or decrease with changes in temperature. Relatively small currents are used through the element to sense the resistance characteristic and determine the temperature while large currents are employed to ignite fuels.

When handling or installing the resistance device, the support for the element 10 by the sleeve 26, the malleable layer 28 and the solidified-from-melt portion 34 substantially reduces breakage of the element 10 from shocks or stress. In use as an igniter, current through the element 10 heats the coil of the element 10 to a temperature in the range from 1,010°C to 1,349°C (1,850°F to 2,460°F) exposing the terminals to a temperature of about 788°C (1,450°F) resulting in temperature gradient, in the end segment of the element 10 where any weakening of the element 10 is supported by the terminal 12. The fused portion 32 forms a good conductive connection between the element 10 and the heat resistant metal of the sleeve 26 which is not substantially deteriated by prolonged exposure to high temperatures. During use, stress caused by different temperature coefficients between the element 10 and the terminal 12 is minimized by the malleable nature of the layer 28 as well as the fused portion 32.

Figure 5:
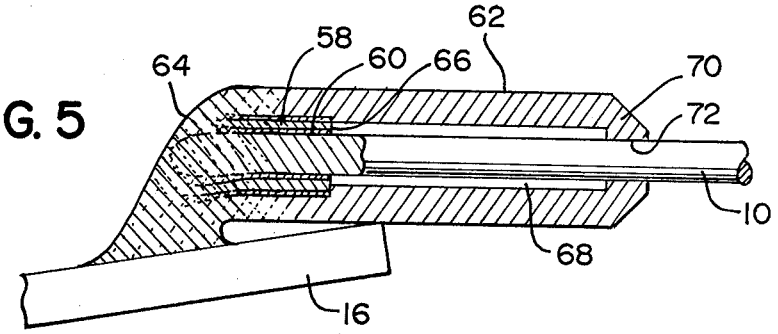
FIG. 5 is a detailed cross sectional side view illustrating the completed modified terminal on the resistance element of FIG. 4.

A modified terminal is shown in FIG. 5 and has an inner sleeve 58 of high temperature metal over the end segment of the element 10 with a layer of malleable metal 60 interposed between the inner sleeve 58 and element 10. The inner sleeve 58 and layer 60 are substantially similar to the sleeve 26 and layer 28 of the embodiment shown in FIG. 3. The modified embodiment differs from the embodiment of FIG. 3 in that an outer sleeve 62 of heat resistant metal is telescoped over the inner sleeve 58. A fused portion 64 joins one end of the outer sleeve 62, one end of the inner sleeve 58, the interposed layer 60 and the end of the element 10, and contains constituents of the high temperature metal, the malleable metal and the refractory resistance material to form a malleable interface. At least a portion of the interposed layer 60 of malleable metal between the inner sleeve 58 and element 10 is unfused with the sleeve or element but solidified from a melt to provide support for the element 10. The outer sleeve 62 extends beyond the end 66 of the inner sleeve 58 over the element 10 leaving a space 68 between the outer sleeve 62 and the element 10. The end 70 of the outer sleeve has a reduced opening 72 surrounding the element 10 to provide support for the element.

Figure 4:
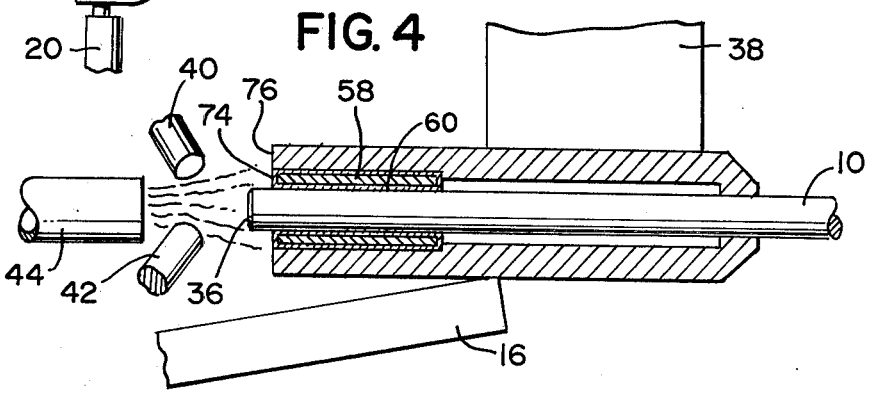
FIG. 4 is a detailed cross sectional side view showing the manufacture of a modified terminal on an electrical resistance element in accordance with the invention.

In the manufacture of the terminal of FIG. 5, the outer sleeve 62 is conveniently made from the same metal as the inner sleeve 58 with the reduced opening 72 being formed by any conventional process such as inwardly swaging the end of a section cut from tubular stock and boring the opening 72 to a size slightly larger than the diameter of the element 10. Ends 36, 74 and 76 of the respective element 10, inner sleeve 58 and outer sleeve 62 are positioned in close proximity on metal strip 16 while intense heat is then applied to ends 36, 74 and 76, as illustrated in FIG. 4, to form the fused portion 64 which joins to the preheated strip 16.

The embodiment of FIG. 5 provides additional support for the element 10 against mechanical shocks and bending stresses. The pacing of the end 70 of the outer sleeve from the end 66 of the inner sleeve and the space 68 forms a beam support which allows for some flexing of the element 10 within the space 68 to distribute bending stresses over a substantial length of the element 10.

Since many variations, modifications and changes in detail can be made to the present embodiments, it is intended that all mater contained in the foregoing description or shown in the accompanying drawing shall be interpreted as illustrative and not in a limiting sense.

What is claimed is:

1. A resistance and terminal comprising
   an elongated resistance element made from a conductive refractory material which is weakened where subjected to a substantial temperature gradient,
   a metal supporting member extending along a segment of the element from one end of the element and at least partially surrounding the segment of the element,
   a fused portion having constituents of the supporting member metal and the refractory material joining the one end of the resistance element to the supporting member, and
   said supporting member having an unfused portion along a substantial portion of the segment providing mechanical support for the element where subject to weakening.

2. A resistance and terminal as claimed in claim 1 wherein
   the refractory material is principally molybdenum disilicide, and
   the metal of the supporting member is capable of withstanding temperatures up to 260°C without substantial deteriation of strength or conductive properties.

3. A resistance and terminal as claimed in claim 2 wherein the metal of the supporting member is capable of withstanding temperatures up to 843°C without substantial deteriation of strength or conductive properties.

4. A resistance and termination as claimed in claim 1 wherein
   the unfused portion of the supporting member along the substantial portion of the segment has substantially less thermal and electrical conductivity per unit area with the element than the fused portion.

5. A resistance and terminal as claimed in claim 1 wherein the supporting member includes a solifified-from-melt portion which supports at least a portion of the segment of the element.

6. A resistance and terminal as claimed in claim 1 wherein a weakened portion of the resistance element due to the application of heat in forming the fused portion is limited to the portion of the element supported by the supporting member by rapidly terminating the application of heat and allowing the terminal to cool.

7. A resistance and terminal as claimed in claim 1 wherein there is included a layer of malleable metal interposed between the supporting member and the element, said malleable metal having a hardness less than 200 Knoop, and the fused portion includes constituents of the refractory metal, the metal of the supporting member and the malleable metal.

8. A resistance and terminal as claimed in claim 7 wherein the malleable metal has a melting point substantially below the melting points of the metal of the supporting member and the refractory material, and the layer of malleable metal includes a solidified-from-melt portion supporting at least a portion of the segment of the element.

9. A resistance and terminal as claimed in claim 8 wherein the refractory material is principally molybdenum disilicide, the metal of the supporting member is an alloy containing iron and chromium, and the malleable metal includes silver.

10. A resistance and terminal as claimed in claim 1 wherein the supportimg member includes a sleeve substantially surrounding the segment of the element, and the fused portion joins the one end of the element to one end of the sleeve.

11. A resistance and terminal comprising an elongated electrical resistance element made from a conductive refractory material;

a member of a first metal for supporting a first end of the element, said first metal being capable of withstanding temperatures at least up to 260°C without substantial deterioration of strength or conductivity;

a layer of second metal interposed between the member and the element, said second metal having a hardness less than 200 Knoop;

a fused portion having constituents of the first metal, the second metal and the element, said fused portion joining the element, the member and the interposed layer.

12. A resistance and terminal as defined in claim 11 wherein the element is principally molybdenum disilicide, the first metal is an alloy containing chromium and iron, and the second metal is silver.

13. A resistance and terminal comprising an elongated electrical resistance element made from a conductive refractory material;

a sleeve of a first metal over a first end of the element, said first metal being capable of withstanding temperatures at least up to 260°C without substantial deterioration of strength or conductivity;

a layer of second metal interposed between the sleeve and the element, said second metal having a hardness less than 200 Knoop;

a fused portion having constituents of the first metal, the second metal and the element, said fused portion joining the first end of the element, an end of the sleeve and the interposed layer.

14. A resistance and terminal as defined in claim 13 wherein the element is principally molybdenum disilicide, the first metal is an alloy containing chromium and iron, and the second metal is silver.

15. A resistance and terminal as defined in claim 13 wherein the second metal has a melting point substantially below the melting points of the element and the first metal, the fused portion is at a first end of the sleeve, and the layer of second metal has an unfused portion solidified from a melt interposed between the sleeve and the element.

16. A resistance and terminal comprising an elongated electrical resistance element made from a conductive refractory material, a first sleeve over an end of the element, and a second sleeve telescoped over the first sleeve and having a first end with a reduced opening beyond a first end of the first sleeve over the element with a space surrounding the element between the first end of the first sleeve and the reduced opening of the second sleeve, said end of the element, a second end of said first sleeve and a second end of said second sleeve being joined together.

17. A resistance and terminal as claimed in claim 16 wherein said end of the element, said second end of the first sleeve and said second end of the second sleeve are joined by a fused portion containing constituents of the element, first sleeve and second sleeve.

18. A resistance and terminal as claimed in claim 17 wherein the element is principally molybdenum disilicide, and the first and second sleeves are made of metals capable of withstanding temperatures up to 260°C without substantial deteriation of strength or conductive properties.

19. A resistance and terminal comprising an elongated electrical resistance element made from a refractory material;

a first sleeve of a first metal over an end of the element, said first metal being capable of withstanding temperatures at least up to 260°C without substantial deterioration of strength or conductivity;

a layer of second metal interposed between the first sleeve and the element, said second metal having a hardness less than 200 Knoop;

a second sleeve of the first metal telescoped over the first sleeve and having a first end with a reduced opening beyond a first end of the first sleeve over the element for supporting the element; and a fused portion having constituents of the first metal, the second metal and the element, said fused portion joining the element, the interposed layer of second metal, a second end of the first sleeve and a second end of the second sleeve.

20. A resistance and terminal as defined in claim 19 wherein the second metal has a melting point substantially below the melting points of the element and the first metal, and the layer of second metal has an unfused portion solidified from a melt interposed between the first sleeve and the element.

21. An electrical resistance device comprising an elongated electrical resistance element containing a principal portion of molybdenum disilicide, and a pair of terminals, one of said pair of terminals formed on each respective end of the element, wherein each of said pair of terminals includes a first sleeve of a heat resistant alloy containing chromium and iron over the respective end of the element;

a layer of silver plated on the interior surface of the first sleeve between the first sleeve and the element;

a second sleeve of the heat resistant alloy telescoped over the first sleeve and having a first end with a reduced opening beyond a first end of the sleeve over the element for supporting the element;

a fused portion having constituents of molybdenum disilicide, silver and heat resistant alloy, said fused portion joining the respective end of the heating element, the layer of silver, a second end of the first sleeve and a second end of the second sleeve; and an unfused portion of the silver layer solidified from a melt between the first sleeve and the element toward the first end of the first sleeve.

* * * * *